US006691882B2

(12) United States Patent
Beyer et al.

(10) Patent No.: US 6,691,882 B2
(45) Date of Patent: Feb. 17, 2004

(54) HANDLING MACHINE FOR THE COMBINED HANDLING OF CONTAINERS AND BULK MATERIALS

(75) Inventors: Manfred Beyer, Düsseldorf (DE); Kurt Hartmann, Duisburg (DE); Dieter Klessinger, Düsseldorf (DE)

(73) Assignee: Gottwald Port Technology GmbH, Düsseldorf (DE)

( * ) Notice: Subject to any disclaimer, the term of this patent is extended or adjusted under 35 U.S.C. 154(b) by 40 days.

(21) Appl. No.: 10/015,023

(22) Filed: Dec. 11, 2001

(65) Prior Publication Data

US 2002/0092819 A1 Jul. 18, 2002

(30) Foreign Application Priority Data

Dec. 11, 2000 (DE) ..... 100 62 516

(51) Int. Cl.[7] ..... B61F 13/00
(52) U.S. Cl. ..... 212/312; 105/215.2; 212/344
(58) Field of Search ..... 212/324, 325, 212/343, 344, 345; 105/215.2

(56) References Cited

U.S. PATENT DOCUMENTS 1,811,931 A * 6/1931 Hilpert
2,914,127 A * 11/1959 Ricouard
3,081,883 A * 3/1963 Minty
3,638,805 A * 2/1972 Garnier ..... 212/38
3,877,391 A * 4/1975 Gimperlein et al. .... 105/163 R
4,188,887 A * 2/1980 Dewing et al. ..... 105/163 R
4,200,162 A * 4/1980 Tax ..... 180/23
4,773,332 A 9/1988 Theurer et al.
5,076,450 A * 12/1991 Shimizu ..... 212/218

FOREIGN PATENT DOCUMENTS

| | | |
|---|---|---|
| DE | 1 990 023 | 7/1968 |
| DE | 38 38 249 | 2/1990 |
| DE | 195 28 555 A1 | 2/1997 |
| DE | 197 08 750 | 8/1998 |
| FR | 2048145 | 6/1969 |

* cited by examiner

*Primary Examiner*—Thomas J. Brahan
(74) *Attorney, Agent, or Firm*—Cohen, Pontani, Lieberman & Pavane

(57) ABSTRACT

A rail-borne handling machine for handling containers and bulk materials in seaports and inland harbors includes a framework for carrying load bearing means and includes gantry supports arranged on the framework. Rail-based traveling gears are connected to the gantry supports of the framework via articulated connections for supporting the framework on rails. Balancers connected to the gantry supports via articulated connections and at least four steerable tire-based traveling gears are connected to the framework via the balancers. The at least four steerable tire-based traveling gears are symmetrical to a longitudinal axis and a transverse axis of said handling machine. Tho handling machine is maneuverable via the at least four steerable tire-based traveling gears when the rail-based traveling gears are raised from the rails.

11 Claims, 3 Drawing Sheets

HANDLING MACHINE FOR THE COMBINED HANDLING OF CONTAINERS AND BULK MATERIALS

BACKGROUND OF THE INVENTION

1. Field of the Invention

The invention relates to a rail-borne handling machine for the combined handling of containers and bulk materials in seaports and inland harbors, having a gantry-like framework which carries the load-bearing means and on the gantry supports of which the rail-based traveling gears or groups of rail-based traveling gears are articulated with swinging action.

2. Description of the Related Art

Handling machines of the construction described above are used in many parts of the world. These machines are designed as standard for quays on which lengths of rail are laid in a fixed manner with the result that they cannot be used with unlimited flexibility although they satisfy most requirements of a handling installation. It is frequently the case, however that greater mobility of this handling machines is required in order for it to be possible for them to be used more flexible than fixed lengths of rail allow. It is particularly the case that new quays which usually use standard concrete components from road-bridge construction are well suited for having tire-based traveling gears traveling over them, with the result that it is possible to do away with the restrictive rail compatibility.

SUMMARY OF THE INVENTION

The object of the present invention is to develop a handling machine for the combined handling of containers and bulk materials in seaports and inland harbors which can be used both for rail-based operation in conventional harbors and universally as a mobile machine.

To achieve the object, the present invention includes a rail-borne handling machine having rail-based traveling gears or groups of rail-based traveling gears, and at least four steerable tire-based traveling gears or groups of tire-based traveling gears arranged symmetrically to the longattitudinal axis and transverse axis of the vehicle. The at least four steerable tire-based traveling gears may be articulated on the gantry supports, thereby allowing the handling machine to be maneuvered on the tire-based traveling gears when the rail-based traveling gears arc raised from the rails.

A basic machine designed in this way is prepared both for mobile use and for rail-based use and is distinguished, depending on the respective use locations, by the alternative usage of tire-based traveling gears or groups of tire-based traveling gears or rail-based traveling gears or groups of rail-based traveling gears. It is thus possible, for example, for a customer who has purchased a rail-borne machine to convert the latter at a later stage into a mobile machine or vice versa. The conversion is effected as required by coupling the tire-based traveling gears or groups of tire-based traveling gears to the basic machine and uncoupling them therefrom.

For unrestricted maneuverability of the handling machine, the tire-based traveling gears or groups of tire-based traveling gears may be pivoted about vertical axes. The machine is preferably steered by electronic control and hydraulic means in accordance with an established program by means of hydraulic motors on the tire-based traveling gears. Each tire-based traveling gear may be pivoted at least through 90° in both directions, with the result that the machine can be steered fully in all directions.

In a preferred embodiment, the rail-based traveling gears or groups of rail-based traveling gears are connected to the gantry supports with swinging action via balancers to composite, for the load and the weight. The tire-based traveling gears or groups of tire-based traveling gears may also be articulated on the balancers. The balancers distribute the weight of the machine uniformly over all the wheels of the respective traveling gears irrespective of track or carriage way unevennesses.

According to a further feature of the present invention, the tire-based traveling gears or groups of tire-based traveling gears are assigned supporting arrangements which, by vertically acting supporting cylinders, support the handling machine in its operating position on ground level allowing the machine to be supported reliably in handling operation during mobile use. The supporting arrangements are arranged in each case in the vicinity of the traveling gears, and are preferably fastened on the balancers. For the supporting forces to be better divided up over the ground level, the supports are favorably arranged in each case on both sides of the vertical longitudinal center planes of the balancer.

The tire-based traveling gears or groups of tire-based traveling gears are coupled to the handling machine and uncoupled therefrom in a straightforward manner in that the machine can be raised by the supporting cylinders. As a result, the rail-based traveling gears or groups of rail-based traveling gears are raised from the rails and also remain in the raised position when the machine is set down on the articulated tire-based traveling gears or groups of tire-based traveling gears.

Since, in one configuration of the invention with the tire-based traveling gears or groups of tire-based traveling gears coupled and/or the supporting cylinders of the supporting arrangement extended, those ends of the balancers which are directed away from the tire-based traveling, gear and the supporting arrangement can be positioned against stops which absorb the supporting moment, the effects of the balancers are eliminated in the supported state, this producing an extremely stable system.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like references characters denote similar elements throughout the several views.

DETAILED DESCRIPTION OF THE PRESENTLY PREFERRED EMBODIMENTS

Figure 1:
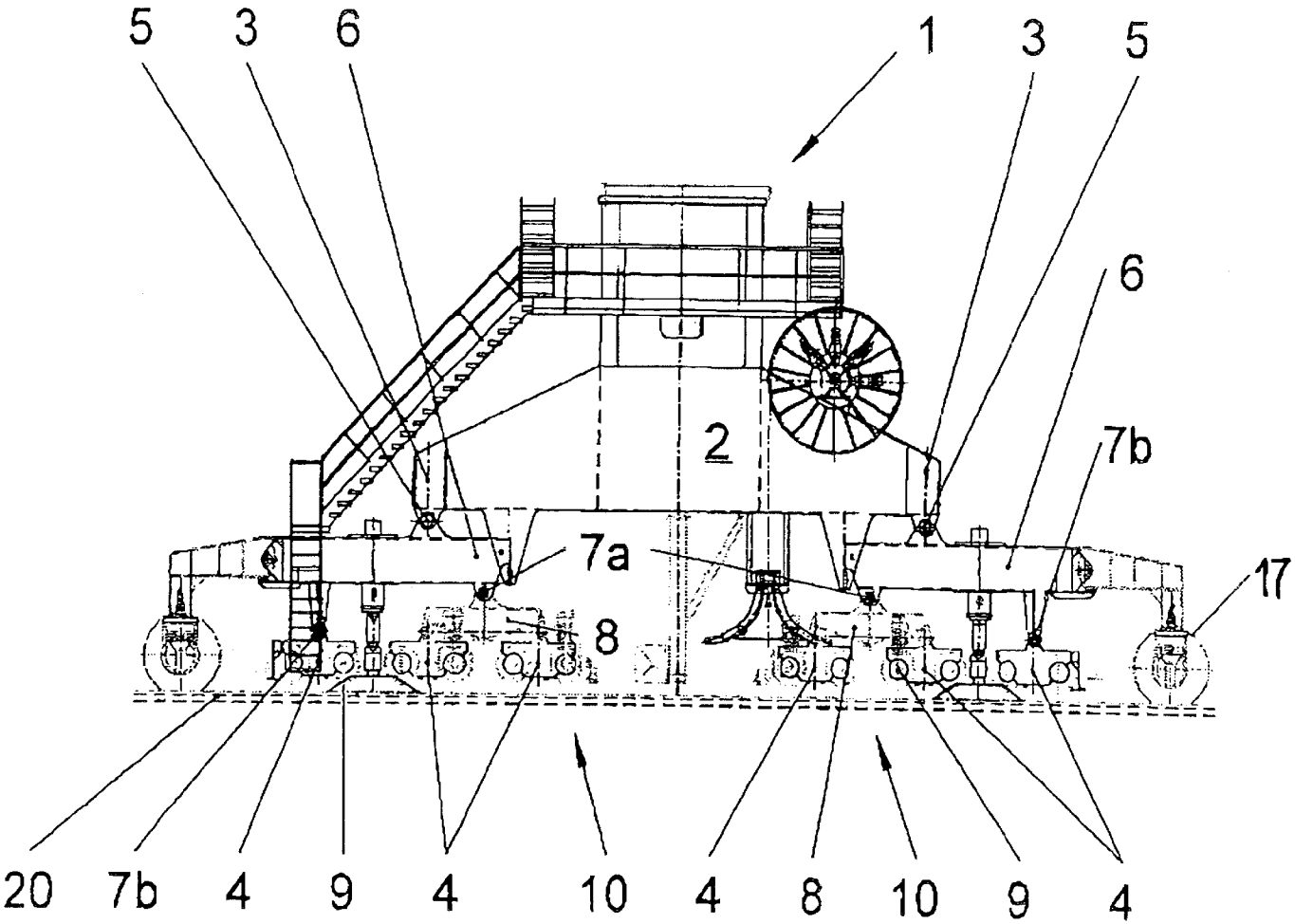
FIG. 1 is a side view of a bottom part of a handling machine according to an embodiment of the present invention.

FIG. 1 shows a bottom frame region of a handling machine 1 according to the present invention. The handling machine 1 may, for example, support a harbor crane used for unloading bulk materials or also a container-handling machine. A gantry-like framework 2 of the handling machine 1 supports the load-bearing means (not illustrated). The framework 2 defines gantry supports 3 on which groups 4 of rail-based traveling gears are arranged directly or with swinging action via rockers 8. For this purpose, balancers 6 are articulated on horizontal pivoting axes 5 at the gantry supports 3. The balancers 6, for their part carry rockers 8 via articulations 7*a*. The groups 4 of rail-based traveling gears are mounted in a rotatable manner either directly via articulations 7*b* or via the rockers 8. Wheels 9 of a rail-based traveling gear 10 are arranged in the groups 4 of rail-based traveling gears. The wheels 9 roll on rails 20.

Figure 2:
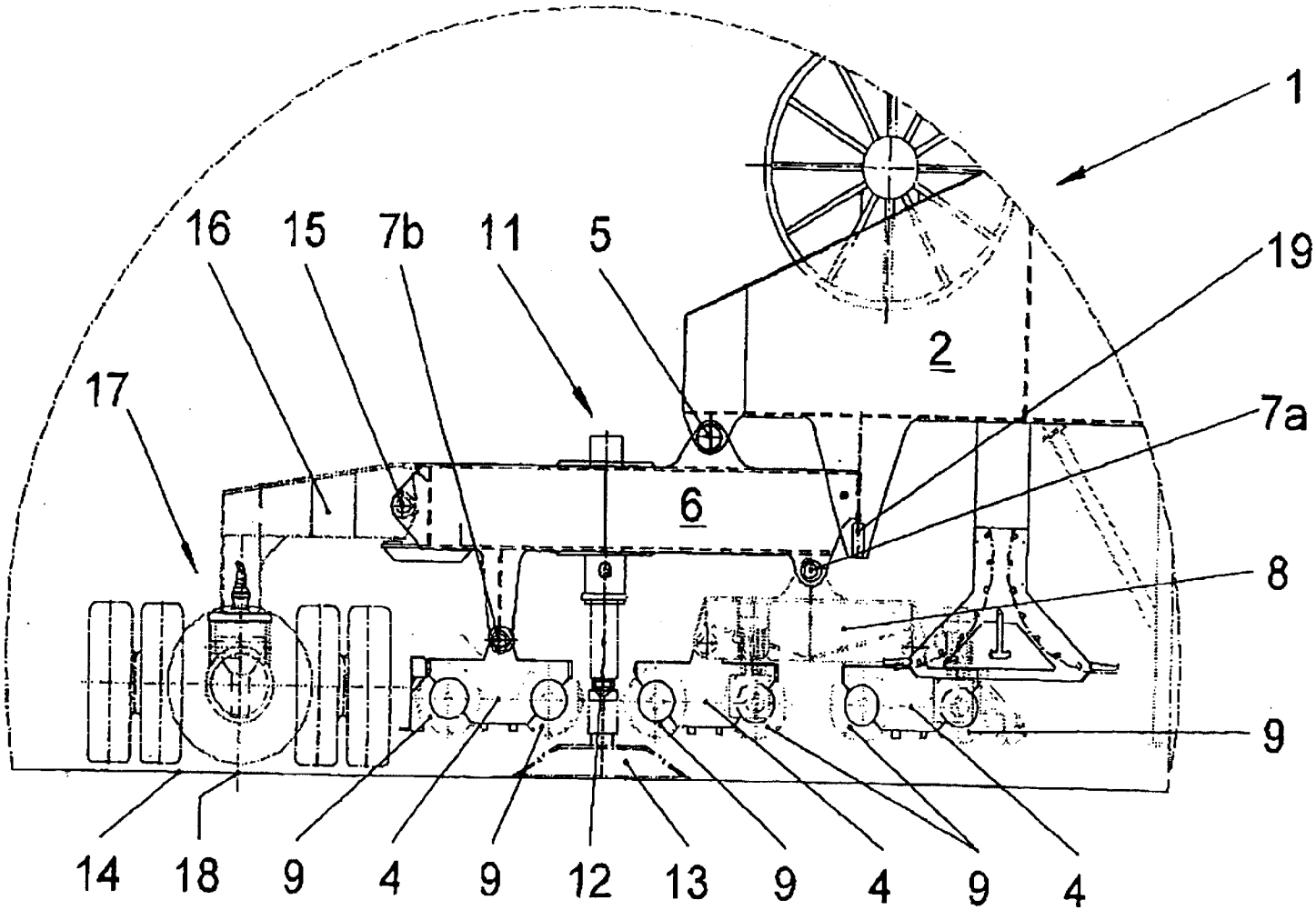
FIG. 2 is an enlarged view of the travelling-gear region of the handling machine according to FIG. 1.
Figure 3:
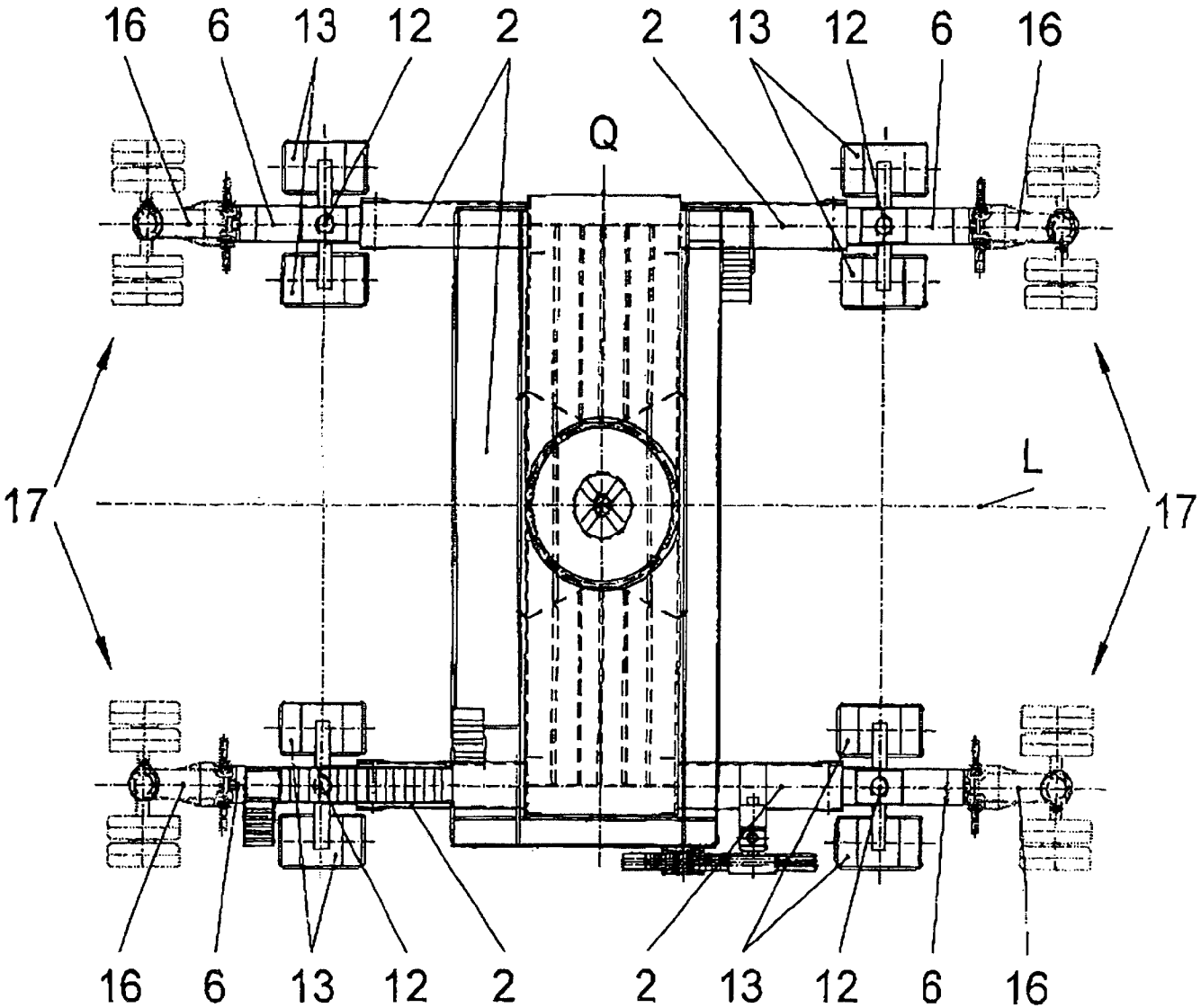
FIG. 3 is a plan view of the handling machine according to FIG. 1.

As can be seen in the enlarged illustration of the travelling region in FIG. 2, a supporting arrangement 11 of the handling machine 1 is also fastened on each balancer 6. The supporting arrangement 11 includes a vertically acting supporting cylinder 12 with a support plate 13 at the bottom end of the supporting cylinder 12 for supporting the handling machine 1 on ground level 14. The support plate 13 is fastened in an articulated manner. As can be seen in FIG. 3, which will be described below, two supporting plates 13 are provided on each balancer 6, on both sides of its longitudinal center axis.

On the side of the balancer 6 which is directed away from the handling machine 1, a group 17 of tire-based traveling gears on a frame 16 is fastened via a bolt connection 15. The group 17 of tire-based traveling gears is pivotable about a vertical axis 18 from the position indicated by the dotted lines into the position illustrated by a solid line. The group 17 of tire-based traveling gears can be attached when the supporting cylinder 12 is extended, and the handling machine 1 is in a raised position in which the rail-based traveling gears have been raised off from the rails. For example, the group 17 of tire-based traveling gears may be rolled up to the balancer 6, so that the bolt connection 15 may be set. After the supporting cylinders 12 are retracted, the handling machine 1 stands on the four tire-based traveling gears 17 and can be displaced freely on the groups of tire-based traveling gears 17. The supporting forces are directed into the gantry-like framework 2 by the group 17 of tire-based traveling gears, via the balancer 6, which can be pivoted about the pivoting axis 5. The end of the balancer 6 which is directed away from the group 17 of traveling gears rests on a supporting bearing 19, i.e. a stop, on the framework 2.

Conversely, once the bolt connection 15 has been released, it is possible for the groups 17 of tire-based traveling gears to be removed and taken away and for the handling machine 1 to be set down on the running rail 20. This is carried out above the length of rail such that, with synchronous lowering of the supporting cylinders 12, the rail wheels 9 of the rail-based traveling gears of the handling machine 1 are set down on the running rail 20. The handling machine 1 may then be used as a straightforward rail vehicle.

In FIG. 3, it can be seen in the plan view of the machine according to the present invention that tile groups 17 of tire-based traveling gears are arranged symmetrically to the longitudinal axis L and transverse axis Q of the vehicle and a total of for groups 17 of tire-based traveling gears are provided. Also shown are the double arrangements of supporting plates 13, of which in each case one is arranged on each side of the longitudinal axis of the balancer 6. The supporting cylinder 12 is arranged centrally in the balancer 6. Otherwise, the same parts have the same designations.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A rail-borne handling machine for handling containers and bulk materials in seaports and inland harbors, comprising:

a framework for carrying load bearing means and including gantry supports arranged on the framework;

rail-based traveling gears connected to said gantry supports of said framework by articulated connections for supporting said framework on rails;

balancers connected to said gantry supports by said articulated connections such that said balancers are pivotal about a substantially horizontal axis, wherein said rail-based traveling gears are connected to said gantry supports by said balancers;

at least four steerable tire-based traveling gears connected to said framework by said balancers, said at least four steerable tire-based traveling gears being symmetrical to a longitudinal axis and a transverse axis of said handling machine, wherein said handling machine is maneuverable by said at least four steerable tire-based traveling gears when said rail-based traveling gears are raised from the rails; and stops arranged on said framework, wherein ends of said balancers that are distal from said each of said at least four steerable tire-based traveling gears are positioned against said stops for absorbing a supporting moment when said handling machine is supported by said at least four steerable tire-based traveling gears.

2. The handling machine of claim 1, wherein said rail-based traveling gears comprise groups of rail-based traveling gears.

3. The handling machine of claim 1, wherein said at least four steerable tire-based traveling gears comprise at least four steerable groups of tire-based traveling gears.

4. The handling machine of claim 1, wherein each of said at least four steerable tire-based traveling gears are connected to said balancers via a releasable connection such that said at least four steerable tire-based traveling gears are selectively coupled to said handling machine.

5. The handling machine of claim 1, wherein said at least four steerable tire-based traveling gears are pivotable about vertical axes.

6. The handling machine of claim 1, further comprising rockers pivotally connected to said balancers, wherein said rail-based traveling gears are connected to said gantry supports by said rockers and said balancers, and wherein each of said at least four steerable tire-based traveling gears is connected to one of said balancers by a pivotal connection about a vertical axis.

7. The handling machine of claim 1, further comprising supporting arrangements corresponding to said at least four steerable tire-based traveling gears, each of said supporting arrangements comprises a vertically acting supporting cylinder for supporting said handling machine in its operating position.

8. The handling machine of claim 7, wherein each of said supporting arrangements is fastened on one of said balancers.

9. The handling machine of claim 8, wherein each of said supporting arrangements comprises support plates arranged on both sides of longitudinal center plane of said one of said balancers on which said each of said supporting arrangements is arranged.

10. The handling machine of claim 7, wherein each of said at least four steerable tire-based traveling gears are connected to said balancers via a releasable connection such that said at least four steerable tire-based traveling gears are selectively coupled to said handling machine, and wherein said handling machine is raisable via said supporting cylinders for allowing said at least four steerable tire-based traveling gears to be selectively coupled and uncoupled.

11. The handling machine of claim 10, wherein ends of said balancers that are distal from said releasable connection to said each of said at least four steerable tire-based traveling gears are positioned against said stops for absorbing a supporting moment when said supporting cylinders of said supporting arrangement are extended and when said handling machine is supported by said at least four steerable tire-based traveling gears.

* * * * *